US005515251A

United States Patent [19]

Abke

[11] Patent Number: 5,515,251

[45] Date of Patent: May 7, 1996

[54] INCORPORATED LIGHTING SYSTEM IN FURNITURE

[75] Inventor: Dieter Abke, Bielefeld, Germany

[73] Assignee: Hermann Abke GmbH & Co. Elektro KG, Lohne, Germany

[21] Appl. No.: 318,384

[22] Filed: Oct. 5, 1994

[30] Foreign Application Priority Data

Oct. 8, 1993 [DE] Germany ..... 43 34 882.3

[51] Int. Cl.[6] ..... A47F 11/10; F21V 29/00

[52] U.S. Cl. ..... 362/127; 362/293; 362/294; 362/345; 362/373

[58] Field of Search ..... 362/127, 148, 362/293, 294, 345, 373, 404

[56] References Cited

U.S. PATENT DOCUMENTS

| | | | |
|---|---|---|---|
| 4,841,422 | 6/1989 | Groh | 362/294 |
| 4,885,668 | 12/1989 | Maglica et al. | 362/345 |
| 4,994,945 | 2/1991 | O'Shea et al. | 362/293 |
| 5,093,769 | 3/1992 | Luntsford | 362/293 |
| 5,138,541 | 8/1992 | Kano | 362/345 |

FOREIGN PATENT DOCUMENTS

| | | | |
|---|---|---|---|
| 3136222 | 3/1983 | Germany | 362/294 |

OTHER PUBLICATIONS

Pamphlet titlted "Disclite" from Lighten Up Products, (no date).

*Primary Examiner*—Denise L. Gromada
*Assistant Examiner*—Sara Sachie Raab
*Attorney, Agent, or Firm*—Salter & Michaelson

[57] ABSTRACT

The invention concerns an incorporated lighting system in furniture with a reflector radiating downward, and the task is established to extensively reduce the downward heat radiation. This task is essentially resolved by the fact that a cold-light reflector is used as the reflector, and this reflector has an apical opening in the region of its apex, whereby a heat distribution plate that is ventilated by air and absorbs heat radiation is arranged above the apical opening.

3 Claims, 1 Drawing Sheet

INCORPORATED LIGHTING SYSTEM IN FURNITURE

BACKGROUND AND SUMMARY OF THE INVENTION

The invention concerns an incorporated lighting system in furniture with a preferably cylindrical outer housing for incorporation in a vertically perforated ceiling or in the cover of a piece of furniture. Incorporated lighting systems in furniture of the given type have a concavely shaped reflector radiating downward, in which a halogen lamp with a laterally mounted base, or the like, is arranged in a horizontally flat-lying manner. Such lighting systems (projection lamps) are known. A construction with small height [space] for incorporation results due to the flat-lying halogen lamp arranged horizontally in the reflector. These lights are therefore incorporated in the ceiling or in the cover of a piece of furniture, for example, in the trim, piece of a cabinet projecting toward the front; the doors of the cabinet open underneath the lighting system. The problem results that there is a heat load of the upper edges of the doors, if these are directly under the lighting system. For this case, various mechanical and/or electronic circuit breakers have been made known, which will prevent an inadmissible heat load of the upper edges of the doors by switching off the projection lamp. In practice, however, it is too expensive, since the mounting of such circuit breaker devices must be produced in addition to the incorporation of the lighting system.

The task of the invention is to develop an incorporated lighting system in furniture of the given type, which exercises only a very small heat load on the irradiated object with a pregiven light flux (luminous intensity), so that, e.g., with the use of a lighting system directly above a door on a piece of furniture, no additional means are necessary for switching off the illumination and/or no other heat protection measures are necessary for the upper edges of the doors.

This task is resolved according to the present invention, in that the concave reflector has an apical opening in the region of its apex.

Inside the reflector, and in fact underneath this apical opening, there is found the horizontally flat-lying halogen lamp, which is fitted to the apical opening more or less, with an appropriate selection of the shape and size of the apical opening. It is thus essential that the backward fraction of heat radiation produced by the illumination means can leave the inside space of the reflector toward the top and is not contained in the light beam in the previously known way, which the radiator emits downward.

Such reflectors with apical opening may be, for example, aluminum reflectors or metallized reflectors. A particularly advantageous form of embodiment of the invention is provided in that a cold-light reflector with apical opening is used. Cold-light reflectors of the known structural type possess a special infrared-transparent coating of the reflector, which transmits toward the outside approximately 60% of the infrared component in the light, and thus the heat radiation in the irradiated light beam is reduced. In combination with the apical opening, which allows the back portion of the heat radiation produced by the lighting means to escape almost completely from the inside space of the reflector, an extremely high reduction of heat radiation will be achieved in the emitted light beam.

Another improvement of the present invention is that the emitted light beam is also covered by an IR blocking filter disk. Two IR blocking filter disks, arranged at a distance as in window-insulating glass disks, appropriately reinforce the filter effect.

The structural control of the heat radiation yielded from the new reflector with apical opening requires special measures, particularly since lighting systems incorporated into furniture must fulfill increased safety specifications and such furniture is often made of plastic. As another feature of the invention, it is thus proposed that a heat distribution plate is arranged essentially horizontally at a distance above the apical opening.

This heat distribution plate should absorb as high a fraction as possible of the heat radiation impinging on it and therefore it is appropriate to design the apical opening of the surface of the heat distribution plate turned toward the reflector in an absorbing manner, for example, to blacken this surface. This also has the advantage that the heat distribution plate blocks light transmission through air vents at the top of the outer housing.

This heat distribution plate is preferably mounted on spacers in such a way that the heat distribution plate is ventilated with air. The heat distribution should be produced on surfaces that are air-ventilated as much as possible. This improves the heat transfer to the air. On the other hand, heat conduction in the material of the heat distribution plate should be reduced throughout in order that mounting with the spacers, which are for the most part made only of plastic, do not produce with temperature loads that are too high. The applicant has obtained excellent results with heat distribution plates of mica.

With respect to the considerable heat radiation, which a cold-light reflector emits to the outside particularly by the reflector wall and which could endanger the adjacent furniture parts with the incorporation of such lighting systems in furniture in the desired minimal space, a lighting system of the invention is provided with a special shield, which is characterized by the fact that the reflector is immersed partially or nearly completely from the top into an inside housing, which surrounds the reflector like a sleeve and is arranged at a distance to the reflector as well as to the outer housing, which clearly makes difficult the heat exchange between inner and outer housing.

This measure, as also the effective air ventilation of the heat distribution plate, is improved by the fact that the distance between the outer housing and the inner housing and/or the distance between the inner housing and the lower part of the reflector is formed by a air-guidance channel with a lower light-input opening and an upper light-output opening, and that air vents are provided at the top of the outer housing.

The technical heat advantages of the features presented above of the new lighting system are of considerable importance. They are persuasive solutions to the established task, both as individual features as well as in combinations (see the formulations given there). However, the combination effect of the features must be underscored as particularly astounding and not predictable for the expert. The combination of these features reduces the heat load of an irradiated object so decisively in the case of the new lighting system with the standard luminous intensity for household use that the object, for example, the upper door edge of a door to a piece of furniture, can be introduced a few millimeters from the light and can be left there for a period of time without heat damage to the object. This combination claimed as a particular invention is characterized by the fact that a cold-light reflector is used as the reflector, that the reflector has an apical opening in the region of its apex, and that a heat distribution plate ventilated by air and absorbing the heat radiation is arranged essentially horizontally at a distance above the apical opening.

The new reflector with apical opening also has considerable advantages for changing the halogen lamps. In the standard case, accessibility from below and the manipulation of a halogen lamp in the relatively small inside space of the reflector is very limited. These disadvantages are resolved in the solution of the invention in that the halogen lamp is held by means of a lamp socket, which is mounted on the outer housing, and that the apical opening of the reflector has a shape and size corresponding to the outer contour of the lamp and socket, such that the reflector can be removed downward from above the lamp and socket, which are stationary in position. The halogen lamp is then freely accessible and sufficient space is present in the outer housing, in order to make possible without problem the exchange of the halogen lamp by the final consumer.

BRIEF DESCRIPTION OF THE DRAWINGS

An example of embodiment of the invention will be described in the following in more detail on the basis of the drawings. Here.

DETAILED DESCRIPTION OF THE INVENTION

Figure 1:
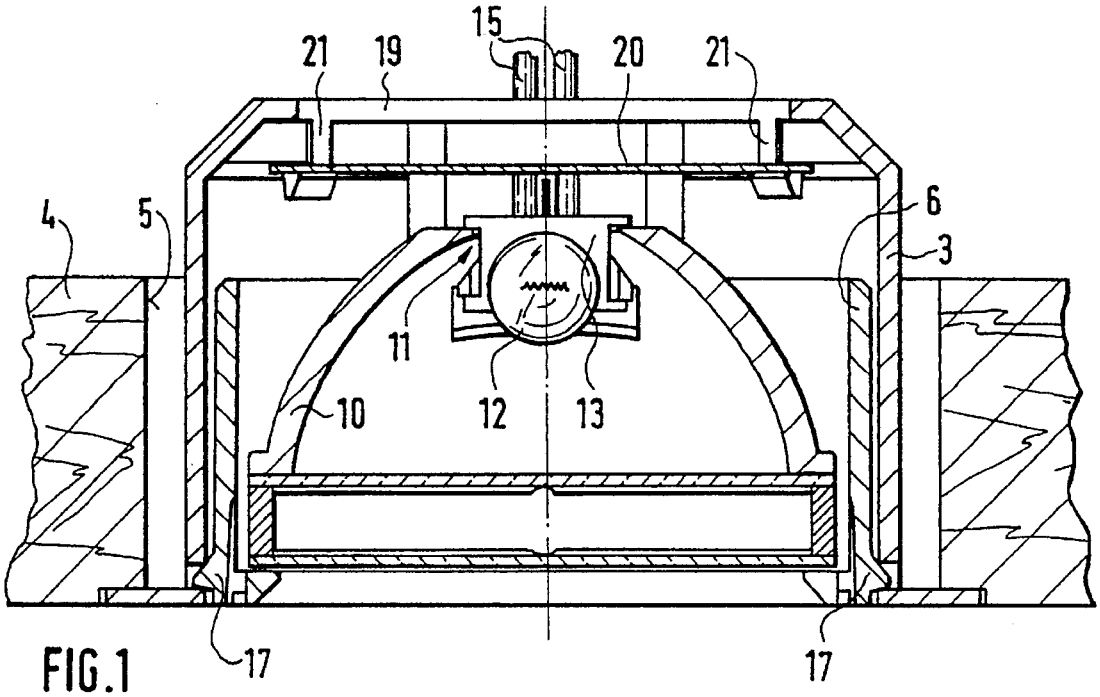
FIG. 1 shows a cross section through a lighting system incorporated in furniture according to the invention.
Figure 2:
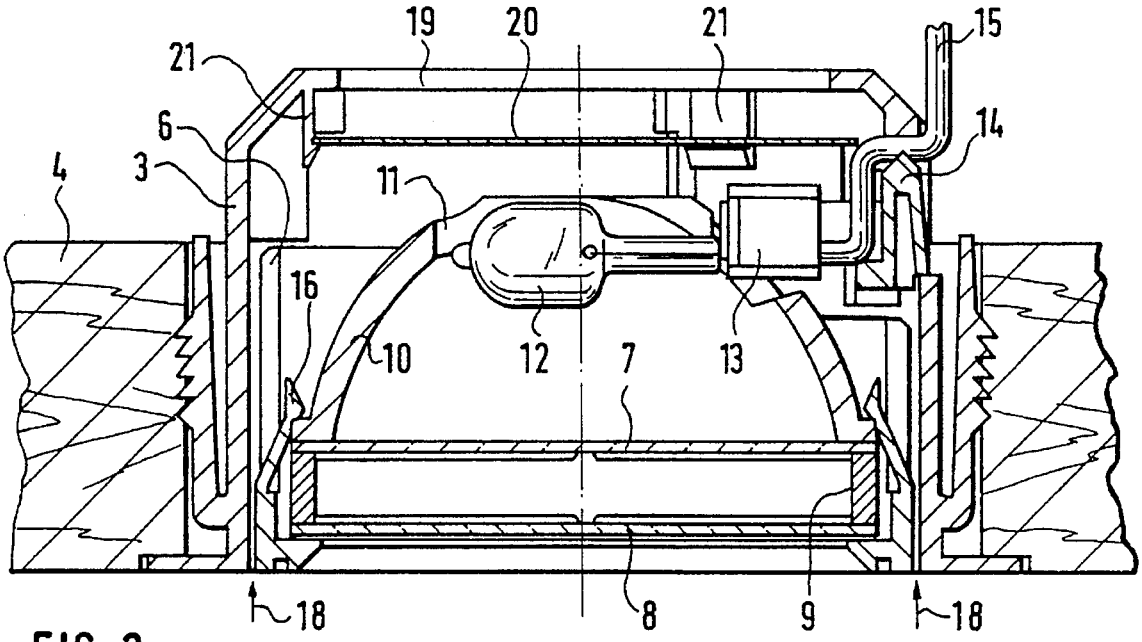
FIG. 2 shows a second section rotated by 90° through the lighting system according to FIG. 1.

An incorporated lighting system in furniture is shown with a cylindrical outer housing 3, which is incorporated in a ceiling 4 of a piece of furniture. For this purpose, a circular borehole 5 is introduced in the bottom.

In addition to outer housing 3, the light represented has a cylindrical inner housing 6, which has an axial height that corresponds approximately to the material thickness of ceiling 4 in this example of embodiment, so that the combustible structural material of the furniture is well shielded due to the double walls of the outer housing and the inner housing.

Two glass disks 7 and 8 are held by means of spacer ring 9 in the inside housing at a distance, of which at least the inner disk 7 is an IR blocking filter disk of known structural type.

The lower edge of a cold-light reflector 10 is mounted on the inner IR blocking filter disk 7. This cold-light reflector is cut open in its apical region, so that apical opening 11 according to the invention is recognizable there, which opening extends first in the region of the arrangement and alignment of halogen lamp 12 as a longitudinal slot that runs crosswise above the apex of the reflector and then is broadened at one side into a larger lateral opening in order to take up lamp socket 13 in that place.

Halogen lamp 12 is mounted in a stationary position by means of lamp socket 13 in outer housing 3, whereby lamp socket 13 is fastened by socket holder 14. The socket holder also forms the strain relief for electrical leads 15.

Reflector 10 and disks 7 and 8 with spacer ring 9 are held in inside housing 6 by means of clips 16 distributed at the periphery (there are 3 clips in the example of embodiment shown), and all parts form a structural unit in the form of an insert, which can be removed at the bottom from outer housing 3, if catch pieces 17 are pressed together; there are two catch pieces lying opposite one another in the example of embodiment shown.

The removal of this insert with the reflector is possible in that the shape and size of disk opening 11 of the reflector is selected somewhat larger than the outer contour of stationary lamp 12 and lamp holder 13. Based on the drawing, it is well imaginable that after removal of this insert, halogen lamp 12 is positioned in the outer housing where it is well accessible from below, so that it can be easily changed without problem by the end user.

An air-guidance channel 18 is formed between outer housing 3 and inner housing 6 with a lower annular gap as an air inlet opening, and an upper annular gap as an air outlet opening. The air flowing into the upper part of the outer housing produced in this way can flow out again through air vent 19 present in the top of the outer housing.

Thus the air ventilates heat distribution plate 20, which is mounted in the top of the outer housing onto spacers 21 molded in the outer housing (three spacers distributed along the periphery) at a sufficient distance from all other structural parts of the lighting system.

It is clear from the drawings that heat distribution plate 20 is arranged above apical opening 11, and this essentially forms the cover at the top in the direction of air vent 19.

Since air vent 19 is dimensioned smaller than the outer edge of heat distribution plate 20, the latter also serves for limiting or extensively blocking the light output at the top through air vent 19. This depends finally on the light transmission of the heat distribution plate. If this latter is blackened on the side turned toward apical opening 11 of the reflector according to a preferred form of embodiment of the invention, in order to extensively absorb the heat radiation occurring there on the heat distribution plate, then the light output through air vent 19 is almost completely blocked.

I claim:

1. A light fixture adapted to be received in a vertically drilled hole in a piece of furniture, said fixture comprising:

a cylindrical housing being relatively short in height and constructed and arranged for being received within the vertically drilled hole in the piece of furniture, said housing having air vents formed in a top portion thereof;

a cold-light reflector mounted on said housing having a downwardly-facing surface with an apical opening formed therein;

a lamp socket mounted laterally outside the reflector on said housing;

a lamp received in the lamp socket, said lamp having a bulb located substantially within said apical opening of the reflector, said apical opening having a shape and size greater than the shape and size of said bulb; and a heat distribution plate mounted within the housing above said reflector along a generally horizontal plane at a distance above said apical opening and below said air vents of the housing, said heat distribution plate being of the type absorbing heat radiation of the lamp radiated upwardly through said apical opening.

2. A light fixture as set forth in claim 1 further comprising an inner housing which surrounds the reflector in the form of a sleeve, said inner housing being located at a distance from said reflector and said cylindrical housing, the space between said inner and cylindrical housings defining an air guidance channel having a lower air inlet opening and an upper air outlet opening.

3. A light fixture as set forth in claim 2, said upper air outlet opening being positioned below said distribution plate for intensifying air ventilation of the distribution plate.

* * * * *